US011691657B2

(12) United States Patent
Staats et al.

(10) Patent No.: US 11,691,657 B2
(45) Date of Patent: Jul. 4, 2023

(54) VEHICLE CONTROL SYSTEM AND METHOD

(71) Applicant: TRANSPORTATION IP HOLDINGS, LLC, Norwalk, CT (US)

(72) Inventors: Andrew Ryan Staats, Cedar Rapids, IA (US); Timothy Allen Schultz, Marion, IA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 1083 days.

(21) Appl. No.: 16/399,019

(22) Filed: Apr. 30, 2019

(65) Prior Publication Data

US 2020/0346674 A1 Nov. 5, 2020

(51) Int. Cl.

| | |
|---|---|
| ***B61L 27/70*** | (2022.01) |
| ***B61L 25/02*** | (2006.01) |
| ***B61L 23/00*** | (2006.01) |
| ***B61L 27/04*** | (2006.01) |
| ***B61L 27/53*** | (2022.01) |
| ***B61L 23/06*** | (2006.01) |
| ***B61L 29/24*** | (2006.01) |
| ***B61L 29/28*** | (2006.01) |

(52) U.S. Cl.

CPC ..... *B61L 27/70* (2022.01); *B61L 23/007* (2013.01); *B61L 23/06* (2013.01); *B61L 25/025* (2013.01); *B61L 27/04* (2013.01); *B61L 27/53* (2022.01); *B61L 29/24* (2013.01); *B61L 29/28* (2013.01); *B61L 2201/00* (2013.01); *B61L 2205/04* (2013.01)

(58) Field of Classification Search

CPC ..... B61L 27/70; B61L 23/007; B61L 23/06; B61L 25/025; B61L 27/04; B61L 27/53; B61L 29/24; B61L 29/28; B61L 2201/00; B61L 2205/04

See application file for complete search history.

(56) References Cited

U.S. PATENT DOCUMENTS

2009/0216395 A1* 8/2009 Kernwein ..... B61L 25/025 701/19
2017/0320507 A1* 11/2017 Denny ..... E01F 9/30
2021/0209936 A1 7/2021 Lucas et al.

FOREIGN PATENT DOCUMENTS

EP 2946982 A1 * 11/2015 ..... B61L 23/06

OTHER PUBLICATIONS

Office Action for corresponding MX Application No. MX/a/2019/013408 dated Dec. 9, 2022 (5 pages).

* cited by examiner

*Primary Examiner* — Zachary L Kuhfuss

(74) *Attorney, Agent, or Firm* — The Small Patent Law Group LLC; Mary D. Lawlor

(57) ABSTRACT

A vehicle control system and method wirelessly communicate from at least one wireless transmitter positioned proximate a route crossing to a wireless receiver of a vehicle via a wireless wayside transceiver. The system and method communicate an indication of whether the route crossing is clear for passage of the vehicle through the route crossing. The system and method receive the indication by the wireless transmitter and using the vehicle receiver. A vehicle controller or an operator of the vehicle can determine whether it is safe for the vehicle to travel through the route crossing based on the indication received by the vehicle receiver from the portable transmitter. The vehicle can then be operated based on the determination.

15 Claims, 5 Drawing Sheets

VEHICLE CONTROL SYSTEM AND METHOD

BACKGROUND OF THE INVENTION

Field of the Invention

The present invention relates to wirelessly indicating flagger state and safety for travel of a locomotive through a railroad crossing that has malfunctioning warning system.

Description of Related Art

In the event of malfunctioning warning system at a railroad crossing, one or more flaggers are required by railroad regulations to be deployed to the railroad crossing to control the safe flow of vehicle traffic across the railroad tracks, e.g., with signs, e.g., "stop" signs. Often, however, the flagger(s) are unable to communicate with an approaching locomotive or with each other.

When a controller of the locomotive receives, in a manner known in the art, notice of the malfunctioning warning system at the railroad crossing, the controller requires the train operator (engineer) to manually enter the number of flaggers deployed at the railroad crossing into the controller. The controller can then use the entered number of flaggers to establish speed targets for the locomotive to travel through the railroad crossing.

A drawback of having the engineer manually enter the number of flaggers is that the incorrect number of flaggers may be entered, thereby allowing the locomotive to travel through the railroad crossing at an unsafe or unauthorized speed.

SUMMARY OF THE INVENTION

Generally, provided, in some non-limiting embodiments or examples, are a method and system of wirelessly indicating flagger state and safety for passage of a locomotive or train through a railroad crossing that can overcome the drawback described above.

In some non-limiting embodiments or examples, each flagger present at a railroad crossing can wear or carry a wireless device that can wirelessly provide data to a wireless receiver or transceiver on-board the locomotive that is coupled to a locomotive controller. By way of the wirelessly provided data, the corresponding flagger can indicate to the controller that he/she is monitoring the railroad crossing and that it is safe or not safe for the locomotive to travel through the railroad crossing. When the data indicates that it is safe for the locomotive to travel through the railroad crossing, the speed of the locomotive through the railroad crossing can be controlled by the controller and/or the train operator based on the number of wireless devices present at the railroad crossing. When the data indicates that it is not safe for the locomotive to travel through the railroad crossing, the controller can prevent or avoid the locomotive from travelling through the railroad crossing until wireless data is received that it is safe for the locomotive to travel through the railroad crossing.

Further preferred and non-limiting embodiments or examples are set forth in the following numbered clauses.

Clause 1: A locomotive control method comprising: (a) wirelessly communicating from at least one wireless portable transmitter positioned proximate a railroad crossing to a wireless locomotive receiver of a locomotive via a wireless wayside transceiver an indication if the railroad crossing is clear for passage of the locomotive through the railroad crossing; and (b) receiving by the locomotive receiver via the wayside transceiver the indication wirelessly communicated by the at least one portable transmitter.

Clause 2: The method of clause 1, further including, prior to step (a) the step of: receiving from an operator of the at least one portable transmitter an input related to the indication.

Clause 3: The method of clause 1 or 2, further including: (c) determining, by a locomotive controller or an operator of the locomotive based on the indication received by the locomotive receiver from the at least one portable transmitter, if it is safe for the locomotive to travel through the railroad crossing.

Clause 4: The method of any one of clauses 1-3, further including: (d) operating the locomotive based on the determination in step (c).

Clause 5: The method of claim any one of clauses 1-4, wherein: the at least one portable transmitter consists of a single portable transmitter; step (c) includes: (c)(1) determining that the indication received by the locomotive receiver is wirelessly communicated by the single portable transmitter; and (c)(2) determining that it is safe for the locomotive to travel through the railroad crossing based on the indication received by the locomotive receiver wirelessly communicated by the single portable transmitter; and step (d) includes operating the locomotive to travel through the railroad crossing at less than a rated track speed.

Clause 6: The method of any one of clauses 1-5, wherein: the at least one portable transmitter includes a plurality of portable transmitters; step (a) includes the plurality of portable transmitters wirelessly communicating a plurality of indications if the railroad crossing is clear for passage of the locomotive through the railroad crossing, wherein the indication wirelessly communicated by each portable transmitter is unique to said portable transmitter; step (b) includes the locomotive receiver receiving the plurality of indications; step (c) includes: (c)(1) determining that the plurality of indications received by the locomotive receiver is wirelessly communicated by the plurality of portable transmitters; and (c)(2) determining that it is safe to for the locomotive to travel through the railroad crossing based on the plurality of indications received by locomotive receiver wirelessly communicated by the plurality of portable transmitters; and step (d) includes operating the locomotive to travel through the railroad crossing at about rated track speed.

Clause 7: The method of any one of clauses 1-6, wherein the at least one portable transmitter comprises a wireless portable transceiver; and wherein the method further comprises: receiving by the portable transceiver from the wayside transceiver a second indication that the locomotive has moved within a predetermined distance of the wayside transceiver; and in response to receiving the second indication, the portable transceiver generating, by a notification means associated with the portable transceiver, a human detectable notification.

Clause 8: The method of any one of clauses 1-7, wherein: the notification means includes at least one of the following: a light, a vibrator, or an audio transducer; and the human detectable notification includes at least one of the following: the light illuminating, the vibrator vibrating, or the audio transducer generating an audible sound.

Clause 9: The method of any one of clauses 1-8, wherein the second indication is generated by the locomotive controller or a wayside controller coupled to the wayside transceiver based on GPS coordinates of the locomotive and the wayside transceiver accessible by the locomotive controller or the wayside controller and used by the locomotive controller or the wayside controller to track movement of the locomotive toward the wayside transceiver.

Clause 10: The method of any one of clauses 1-9, wherein the indication is based on a manual input to a contact (virtual or mechanical) of the portable transmitter.

Clause 11: The method of any one of clauses 1-10, wherein step (d) includes controlling a speed of the locomotive through the railroad crossing based on GPS coordinates of the locomotive and the wayside transceiver used to track movement of the locomotive toward the wayside transceiver.

Clause 12: A locomotive control method comprising: (a) wirelessly transmitting, by each of one or more wireless transmitters positioned proximate a railroad crossing, data that the railroad crossing is clear or not clear for passage of a locomotive through the railroad crossing; (b) receiving, by a wireless receiver of the locomotive, the data transmitted in step (a); (c) determining, by a controller or an operator of the locomotive based on the data received in step (b), if it is safe for the locomotive to travel through the railroad crossing; and (d) controlling, by the controller or the operator, the locomotive to: (1) travel through the railroad crossing if it is determined in step (c) that it is safe for the locomotive to travel through the railroad crossing; or (2) not travel through the railroad crossing if it is determined in step (c) that it is not safe for the locomotive to travel through the railroad crossing.

Clause 13: The method of clause 12, wherein the data includes an indication of the presence of an operator of the wireless transmitter.

Clause 14: The method of clause 12 or 13, wherein step (d)(1) includes the locomotive traveling through the railroad crossing at about rated track speed when the wireless receiver of the locomotive receives the data in step (b) from two wireless transmitters positioned proximate the railroad crossing.

Clause 15: The method of any one of clauses 12-14, wherein: each wireless transmitter includes a identifier that is unique to said wireless transmitter and which is different from an identifier of each other wireless transmitter; and the data transmitted by each wireless transmitter includes said unique identifier.

Clause 16: The method of any one of clauses 12-15, wherein step (d)(1) includes the locomotive traveling through the railroad crossing at less than rated track speed when the wireless receiver of the locomotive receives the data in step (b) from only a single wireless transmitter positioned proximate the railroad crossing.

Clause 17: The method of any one of clauses 12-16, wherein the locomotive traveling through the railroad crossing at less than rated track speed includes the locomotive traveling through the railroad crossing at ≤about 15 miles/hour or ≤about 25 kilometers/hour.

Clause 18: The method of any one of clauses 12-17, wherein the wireless transmitter includes one or more contacts (virtual or mechanical) for receiving input related to the data.

Clause 19: The method of any one of clauses 12-18, wherein the data is wirelessly transmitted from the wireless transmitter to the wireless receiver via a wireless wayside transceiver.

Clause 20: The method of any one of clauses 12-19, wherein the wayside transceiver is positioned proximate the railroad crossing.

Clause 21: The method of any one of clauses 12-20, wherein at least one of the wireless receiver and the wireless transmitter comprises a wireless transceiver.

Clause 22: The method of any one of clauses 12-21, wherein each wireless transmitter comprises a wireless transceiver; and wherein the method further comprises: receiving by each wireless transceiver second wirelessly transmitted data that the locomotive has moved within a predetermined distance of the railroad crossing; and in response to each wireless transceiver receiving the second data, a notification means of the wireless transmitter including the wireless transceiver generating a human detectable notification.

Clause 23: The method of any one of clauses 12-22, wherein: the notification means includes at least one of the following: a light, a vibrator, or an audio transducer; and the human detectable notification includes at least one of the following: the light illuminating, the vibrator vibrating, or the audio transducer generating an audible sound.

Clause 24: The method of any one of clauses 1-23, wherein the second data is based on a distance between the locomotive and the railroad crossing.

Clause 25: A locomotive control system comprising: at least one wireless portable transceiver positioned proximate a railroad crossing; and a locomotive including an on-board wireless locomotive transceiver and a locomotive controller, wherein: each portable transceiver is programmed or configured to wirelessly transmit data that the railroad crossing is clear or not clear for passage of the locomotive through the railroad crossing; and the locomotive transceiver is programmed or configured to receive the data transmitted by each portable transceiver and to provide the received data to the locomotive controller which is programmed or configured to control the locomotive to travel or not travel through the railroad crossing based on the provided data.

Clause 26: The system of clause 25, wherein the at least one portable transceiver includes first and second portable transceivers in communication with each other directly or via a wireless wayside transceiver, wherein the first and second portable transceivers are programmed or configured whereupon, in response to user input thereon, the first portable transceiver outputs a wireless notice which is received by the second portable transceiver which, in response to receiving the notice, causes a notification means of the second portable transceiver to generate a human detectable notification.

Clause 27: The system of any one of clauses 25-26, wherein: the notification means includes at least one of the following: a light, a vibrator, or an audio transducer; and the human detectable notification includes at least one of the following: the light illuminating, the vibrator vibrating, or the audio transducer generating an audible sound.

Clause 28: The system of any one of clauses 25-27, wherein: the locomotive transceiver is further programmed or configured to wirelessly transmit second data generated by the locomotive controller that a distance between the locomotive and the railroad crossing is within a predetermined distance; and each portable transceiver is further programmed or configured receive the second data and to cause a notification means of the portable transceiver to generate a human detectable notification based on the received second data.

Clause 29: The system of any one of clauses 25-28, further including a wireless wayside transceiver programmed or configured as a repeater to receive the data transmitted by each portable transceiver and to retransmit the received data to the locomotive transceiver and/or for receiving the second data transmitted the locomotive transceiver and to retransmit the received second data to each portable transceiver.

Clause 30: The system of any one of clauses 25-29, wherein: the wayside transceiver is positioned proximate the railroad crossing; and the distance between the locomotive and the railroad crossing is based on GPS coordinates of the locomotive and the wayside transceiver.

Clause 31: A locomotive control method, comprising controlling a locomotive to safely approach and travel through a railroad crossing based on input received about one or more of the following: state of functioning of safety devices present at the railroad crossing; state of functioning of early warning devices present at the railroad crossing; state of health of the railroad crossing; and/or state of traffic flow across the railroad crossing.

Clause 32: The method of clause 31, further comprising providing the input directly to the locomotive via one or more remote devices triggered by human input.

Clause 33: The method of clause 31 or 32, further comprising providing the input indirectly to the locomotive via a communication link disposed proximate the railroad crossing.

Clause 34: The method of any one of clauses 31-33, further comprising determining an allowed speed for the locomotive based on the received input.

Clause 35: The method of any one of clauses 31-34, further comprising adjusting a speed of the locomotive from a current speed to the allowed speed.

Clause 36: The method of any one of clauses 31-35, further comprising interrogating a second remote device from a first remote device to provide the input.

Clause 37: The method of any one of clauses 31-36, further comprising delivering the input from the first remote device directly to the locomotive or indirectly to the locomotive via the second remote device.

Clause 38: The method of any one of clauses 31-37, further comprising adjusting the speed of the locomotive such that the locomotive does not travel across the railroad crossing.

BRIEF DESCRIPTION OF THE DRAWINGS

These and other features of the present invention will become more apparent from the following description in which reference is made to the appended drawings wherein.

DESCRIPTION OF THE INVENTION

Figure 1:
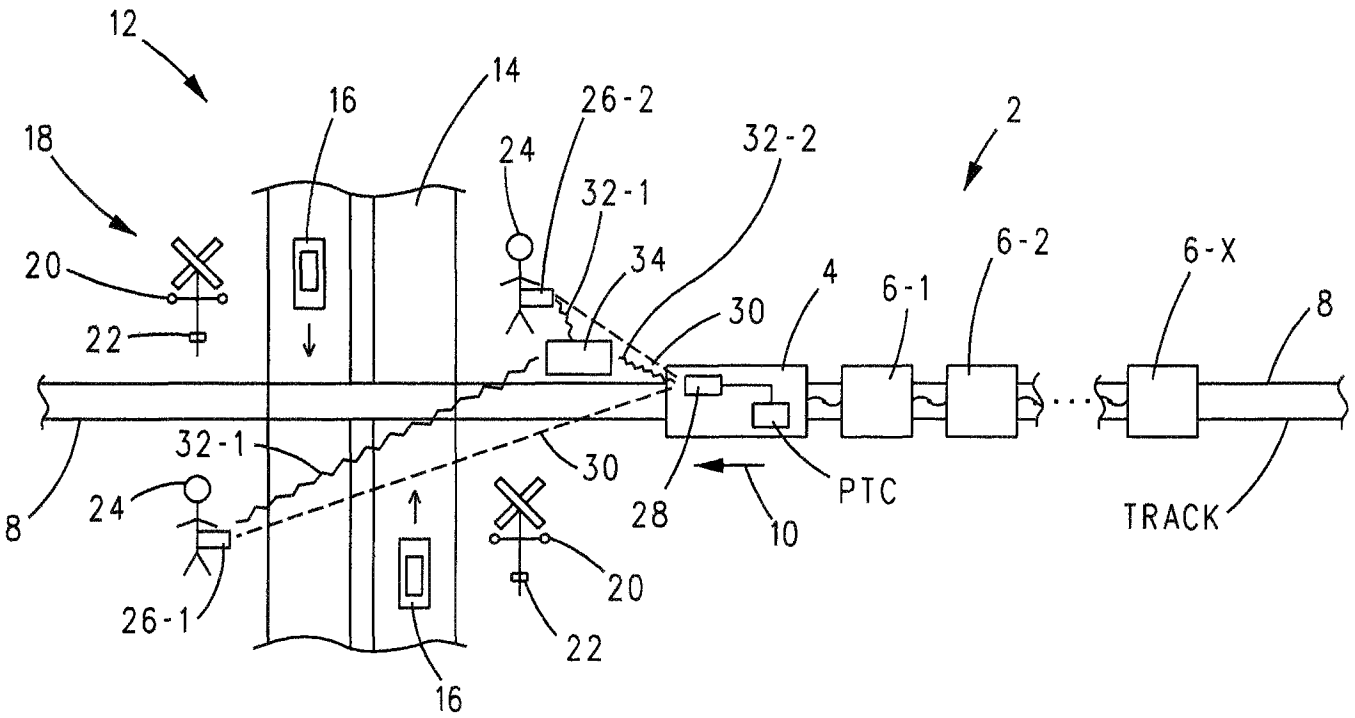
FIG. 1 is a plan, schematic view of an example railroad crossing including a malfunctioning warning system, where flaggers carrying portable wireless devices are positioned and, via the portable wireless devices, in wireless communication with locomotive controller on-board an approaching locomotive via a wireless locomotive receiver (transceiver), either directly or via a wireless wayside transceiver.

Various non-limiting examples will now be described with reference to the accompanying figures where like reference numbers correspond to like or functionally equivalent elements.

For purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example (s) illustrated in the attached drawings, and described in the following specification, are simply exemplary examples or aspects of the invention. Hence, the specific examples or aspects disclosed herein are not to be construed as limiting.

With reference to FIG. 1, in some non-limiting embodiments or examples, a train 2 can include a locomotive 4 and may include any number of cars 6-1-6-X including zero cars. In the example train 2 shown in FIG. 1, locomotive 4 is the lead vehicle of the train and car 6-X is the last vehicle of train 2. However, this is not to be construed in a limiting sense since it is envisioned that the lead vehicle of train 2 can be a car 6 other than locomotive 4, e.g., locomotive 4 can be positioned in train 2 between the lead vehicle and the last vehicle. Herein, locomotive 4 will be considered the lead vehicle of train 2 including cars 6-1-6-X. Herein, "train 2" and "locomotive 4" may be used interchangeably.

In the example shown in FIG. 1, train 2 is traveling on track 8 in a direction of arrow 10 toward an at-grade railroad crossing 12. In some non-limiting embodiments or examples, railroad crossing 12 can be the intersection of track 8 and a road or roadway 14 on which one or more vehicles 16 can travel over track 8.

In some non-limiting embodiments or examples, railroad crossing 12 can include a warning system 18. In some non-limiting embodiments or examples, warning system 18 can include some or all of the following: one or more red lights 20, a bell 22, and, optionally, a crossing gate (not shown), all of which can operate in a manner known in the art in response to train 2 approaching railroad crossing 12. For example, when train 2 is a first distance from railroad crossing 12, the red lights 20 can commence flashing and the bell 22 can commence sounding. When train 2 moves to a second, closer distance to railroad crossing 12, any crossing gates of warning system 18 can lower at least partially across roadway 14 to block the travel of vehicle(s) 16 over track 8 in a manner known in the art.

In some non-limiting embodiments or examples, the flashing of red lights 20 and the sounding of bell 22 can, in an example, be activated about 30 seconds before train 2 arrives at railroad crossing 12, assuming train 2 is traveling at rated track speed. In some non-limiting embodiments or examples, any optional crossing gates of warning system 18 can be lowered about 15 to 20 seconds before train 2 arrives at railroad crossing 12, again assuming train 2 is traveling at rated track speed. If a train is traveling at a greater than or less than a rated track speed, the time red lights 20 and bell 22 are activated and/or time optional crossing gates are lowered before the train arrives at railroad crossing 12 may be decreased or increased accordingly.

Since the red lights 20, bell 22, and, optionally, crossing gate(s) of warning system 18 are well known in the art, the features and/or functions thereof will not be described further herein to avoid unnecessary description. Similarly, since the manner in which the presence of train 2 approaching railroad crossing 12 and, in particular, when train 2 is the first distance and the second distance from railroad crossing 12, is well known in the art, a further description of the means by which one or both of these distances is determined will not be described herein to avoid unnecessary description.

In some non-limiting embodiments or examples, when warning system 18 or any part thereof malfunctions, one or more human flaggers 24 are required by railroad regulation to be stationed or positioned at or proximate railroad crossing 12 to help vehicles 16 move safely across track 8. In some non-limiting embodiments or examples, a flagger 24 typically carries a sign, e.g., a "stop" sign, that the flagger can display to oncoming vehicles 16 when train 2 is approaching railroad crossing 12. When the flagger 24 does not detect train 2 approaching railroad crossing 12 or after train 2 has passed through railroad crossing 12, the flagger may quit displaying the "stop" side of the sign to vehicles 16.

In some non-limiting embodiments or examples in accordance with the principles of the present invention, each of the one or more flaggers 24 present at railroad crossing 12 having a malfunctioning warning system 18 may be equipped with or carry a portable wireless device 26 that said flagger 24 can utilize to wirelessly communicate data to a wireless locomotive receiver or transceiver 28 provided on-board train 2, e.g., on-board locomotive 4, either directly via a wireless communication channel 30 between wireless device 26 and locomotive receiver or transceiver 28, or indirectly via a wireless communication channel 32 that includes a wireless wayside transceiver 34. In an example, the wireless communication channel 32 between a wireless device 26 and wireless locomotive receiver or transceiver 28 can include a first portion 32-1 between wireless device 26 and wireless wayside transceiver 34, and a second portion 32-2 between wireless wayside transceiver 34 and wireless locomotive receiver or transceiver 28.

Where two or more wireless devices 26 communicate data with wireless locomotive receiver or transceiver 28 via wireless wayside transceiver 34, second portion 32-2 of wireless communication channel 32 can include, in any suitable and/or desirable manner, data included on the first portion 32-1 of wireless communication channel 32 output by each wireless device 26. That is, wireless wayside transceiver 34 can communicate the data from two or more wireless devices 26 to locomotive receiver or transceiver 28, which can be programmed or configured to recognize the data being transmitted by each wireless device 26 separately from each other wireless device 26.

In some non-limiting embodiments or examples, the particular wireless protocol utilized for the first portion 32-1 of wireless communication channel 32 can be selected in any suitable and/or desirable manner. In some non-limiting embodiments or examples, the wireless protocol can be WiMAX, a wireless local loop (WLL), a Zigbee wireless mesh network, Bluetooth, and the like. However, this is not to be construed in a limiting sense since it is envisioned that any suitable and/or desirable wireless protocol may be utilized for communication between wireless wayside transceiver 34 and each wireless device 26.

In some non-limiting embodiments or examples, where wireless communication channel 30 is used by each wireless device 26 to communicate directly with wireless locomotive receiver or transceiver 28, wireless communication channel 30 can, in an example, include one or more frequencies at a sufficient power level to enable communication when wireless locomotive receiver or transceiver 28 is at least the first distance away from railroad crossing 12. In an example, this first distance can be a distance where train 2 traveling at rated track speed toward railroad crossing 12 is about 30 seconds away from railroad crossing 12. However, this is not to be construed in a limiting sense since first distance can be a greater (or lesser) distance.

In some non-limiting embodiments or examples, the frequencies utilized by wireless communication channel 30 can include at least a portion of the VHF radio spectrum, and, more particularly, frequencies from 220 MHz to 225 MHz. However, this is not to be construed in a limiting sense since it is envisioned that wireless communication channel 30 may be implemented at any suitable and/or desirable frequency or band of frequencies.

In some non-limiting embodiments or examples, the second portion 32-2 of wireless communication channel 32 can be implemented in the same manner as wireless communication channel 30. However, this is not to be construed in a limiting sense.

In some non-limiting embodiments or examples, wireless communication channel 30, wireless communication channel 32, first portion 32-1 of wireless communication channel 32, and/or second portion 32-2 of wireless communication channel 32 can be implemented via a cellular telephone network. In this example, one, or two, or more of wireless wayside transceiver 34, RF transceiver 60, and/or RF transceiver 74 can be realized by a cellular radio. However, this is not to be construed in a limiting sense.

In some non-limiting embodiments or examples, where each of two or more wireless devices 26 are deployed proximate railroad crossing 12, each wireless device 26 can be programmed or configured with a unique identifier that enables wireless locomotive receiver or transceiver 28 to distinguish a signal output by said wireless device 26 from a signal output by another wireless device 26. In this way, each signal output by each wireless device 26 on wireless communication channel 32 and/or wireless communication channel 30 can include the unique identifier from which wireless locomotive receiver or transceiver 28 can determine which wireless device 26 output the signal from each other wireless device 26 that may be able to communicate with wireless locomotive receiver or transceiver 28.

In some non-limiting embodiments or examples, each signal transmitted on wireless communication channel 30 and/or wireless communication channel 32 can include data that is modulated on a carrier signal. However, this is not to be construed in the limiting sense.

Figure 2:
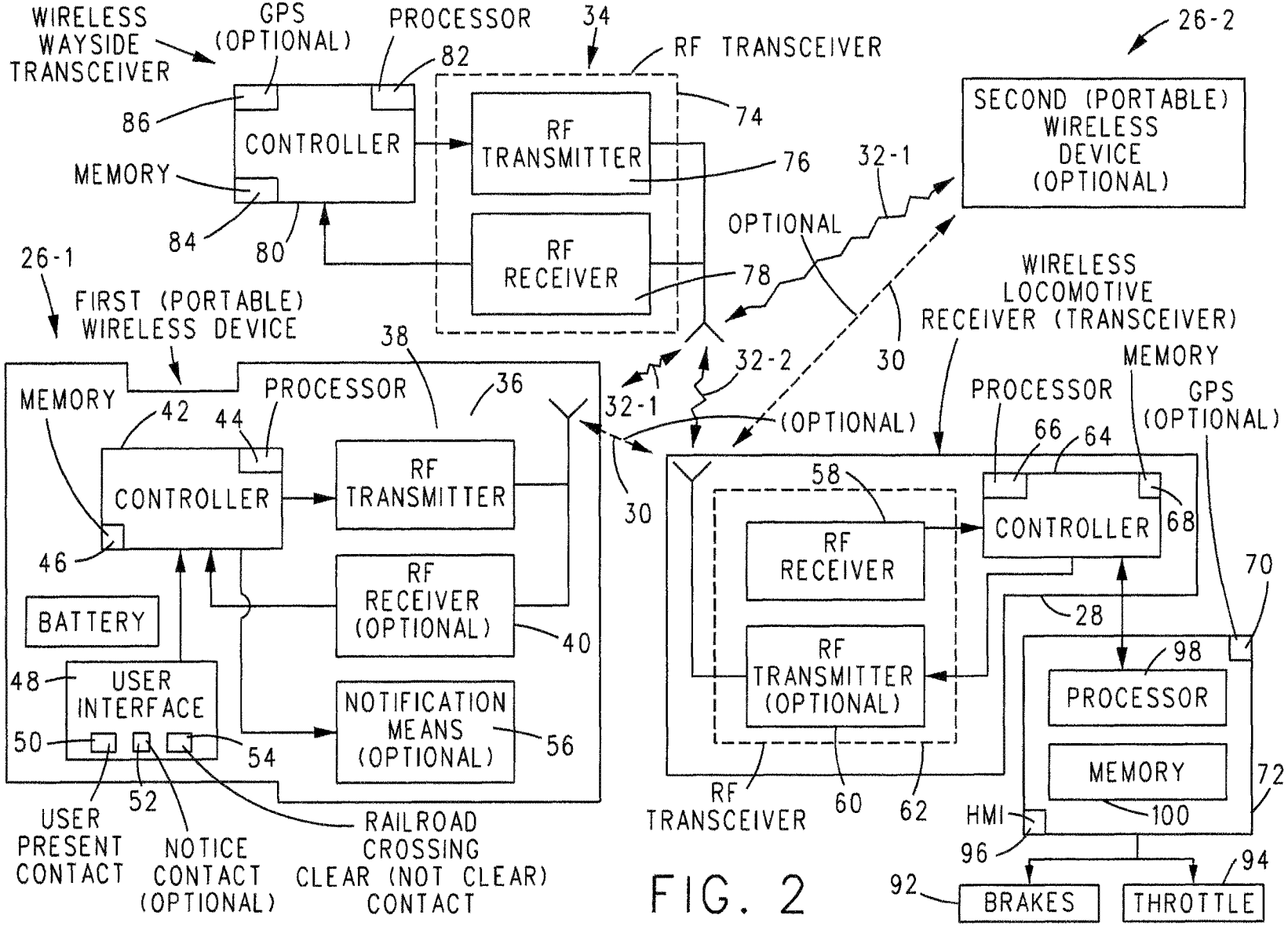
FIG. 2 are block diagrams of one portable wireless device, the wireless locomotive receiver, the locomotive controller, and the wireless wayside transceiver of FIG. 1.

With reference to FIG. 2 and with continuing reference to FIG. 1, in some non-limiting embodiments or examples, a locomotive control system in accordance with the principles of the present invention can include a first wireless device 26-1 and an optional second wireless device 26-2 similar to first wireless device 26-1. As mentioned above, each flagger 24 can be equipped with or carry a wireless device 26. In some non-limiting embodiments or examples, each wireless device 26 can include an RF transmitter 38 and an optional RF receiver 40. RF transmitter 38 and RF receiver 40, when provided together, can comprise an RF transceiver 36 of wireless device 26. For the purpose of discussion, each wireless device 26 may be described hereinafter as comprising RF transceiver 36. However, this is not to be construed in a limiting sense since it is envisioned that each wireless device 26 may include only RF transmitter 38 without RF receiver 40 as may be deemed suitable and/or desirable for a particular application.

In some non-limiting embodiments or examples, each wireless device 26 can also include a controller 42 including a processor 44 and memory 46. Each wireless device 26 can also include a user interface 48 coupled to provide user input to controller 42 from a flagger 24 utilizing said wireless device 26. In some non-limiting embodiments or examples, user interface 48 can include a "user present" contact or switch 50, an optional "notice" contact or switch 52, and a "railroad crossing clear" contact or switch 54. Each contact or switch 50, 52, and 54 may be a mechanical contact or a virtual contact implemented on a display screen of user interface 48 having suitable circuitry for recognizing when said virtual contact is activated by a flagger 24. Herein, each contact 50, 52, and 54 will be considered herein as being a mechanical contact. However, this is not to be construed in a limiting sense.

In some non-limiting embodiments or examples, each wireless device 26 can also include an optional notification means 56. In an example, notification means 56 can be a light, a vibrator, and/or an audio transducer that can output a human detectable notification comprising the light illuminating or flashing, the vibrator vibrating, and/or the audio transducer generating an audible sound. However, this is not to be construed in a limiting sense.

In some non-limiting embodiments or examples, wireless locomotive receiver or transceiver 28 can include an RF receiver 58 and an optional RF transmitter 60. RF receiver 58 and RF transmitter 60, when provided together, can comprise an RF transceiver 62 of wireless locomotive receiver or transceiver 28. Wireless locomotive receiver or transceiver 28 can also include a controller 64 comprising a processor 66 and memory 68. Controller 64 can be programmed or configured to demodulate data from RF signals received by RF receiver 58 and provide said demodulated data to a locomotive controller 72 which can comprise a processor 98, a memory 100, and an optional GPS receiver 70. Controller 64 can also be programmed or configured to modulate data received from locomotive controller 72 onto an RF signal output by RF transmitter 60.

Locomotive controller 72 can be programmed or configured to directly or indirectly control whether locomotive 4 travels through railroad crossing 12 and, if so, a speed that locomotive 4 travels through railroad crossing 12. Direct control can include locomotive controller 72, with or without train operator intervention, allowing or disallowing locomotive 4 to travel through railroad crossing 12. Indirect control may take the form of one or more signals or notifications output to an operator of locomotive 4, via, for example, a human machine interface (HMI) 96 of locomotive controller 72, that locomotive 4 is permitted or not permitted to travel through railroad crossing 12 and, when locomotive 4 is permitted to travel through railroad crossing 12, a permitted speed that locomotive 4 may cross railroad crossing 12. The train operator can then respond to the signals or notifications by controlling locomotive 4 accordingly. In some non-limiting embodiments or examples, HMI 96 may include output means, such as, for example, a display, lights, audio speaker, and the like, and may include input means, such as, for example, a keyboard, switches, or contacts, a touch panel, e.g., as part of the display, and the like. The features of HMI 96 can be selected by one skilled in the art from a variety of input means and output means known in the art and is not to be construed in a limiting sense.

In some non-limiting embodiments or examples, RF transmitter 60, when provided, can be utilized by locomotive controller 72 to transmit modulated data to each wireless device 26, either directly or via wireless wayside transceiver 34.

In some non-limiting embodiments or examples, wireless wayside transceiver 34 can be positioned proximate railroad crossing 12 and can include an RF transceiver 74 including an RF transmitter 76 and an RF receiver 78. Wireless wayside transceiver 34 can also include a controller 80 including a processor 82, a memory 84, and an optional GPS receiver 86.

Each controller 42, 64, and 80 can be programmed or configured to demodulate data from RF signals received by the corresponding RF receiver 40, 58, and 70. Each said controller 42, 64, and 80 may also be programmed or configured to modulate data onto RF signals output by the corresponding RF transmitter 38, 60, and 76. The operation of each RF transmitter and RF receiver described above is well known in the art and is not to be construed in a limiting sense.

In some non-limiting embodiments or examples, controller 64 of wireless locomotive receiver or transceiver 28 may be an interface between locomotive controller 72 and RF receiver 58 and/or RF transmitter 60 when provided. In some non-limiting embodiments or examples, controller 64 may be omitted, whereupon locomotive controller 72 can be programmed or configured to demodulate data from RF signals received by RF receiver 58 and/or to modulate data onto RF signals output by RF transmitter 60.

In some non-limiting embodiments or examples, in operation of the locomotive control system shown in FIG. 2, first wireless device 26-1 can be controlled by a flagger 24 who is positioned proximate railroad crossing 12. In another example, a plurality of wireless devices 26 (26-1, 26-2) can be controlled by a like plurality of flagger 24 positioned proximate railroad crossing 12. However, this is not to be construed in a limiting sense since it is envisioned that only a single wireless device 26 may be provided proximate railroad crossing 12. In an example, each wireless device 26 can be a handheld device that can be carried by the flagger 24 or a device worn by the flagger. However, this is not to be construed in a limiting sense.

In some non-limiting embodiments or examples, RF transceiver 36 of each wireless device 26 can be programmed or configured to wirelessly transmit data that railroad crossing 12 is clear or not clear for the passage of locomotive 4 through railroad crossing 12. In some non-limiting embodiments or examples, RF transceiver 62 of wireless locomotive receiver or transceiver 28 can be programmed or configured to receive the data transmitted by each RF transceiver 36, which received data can be provided to locomotive controller 72 which can be programmed or configured to control locomotive 4 to travel or not to travel through railroad crossing 12 based on the provided received data. In an example, if the data received by locomotive controller 72 from RF transceiver 36 via locomotive transceiver 62 indicates that railroad crossing 12 is clear for the passage of locomotive 4 therethrough, locomotive controller 72 can directly or indirectly control locomotive 4 to travel through railroad crossing 12. Conversely, if the data received by locomotive controller 72 indicates that railroad crossing 12 is not clear for the passage of locomotive 4 through railroad crossing 12, e.g., a vehicle 16 is on track 8, locomotive controller 72 can be programmed or configured to prevent locomotive 4 from traveling through railroad crossing 12, e.g., via applying the brakes of train 2, by reducing or eliminating the power applied by the engine of locomotive 4, or some combination thereof.

In some non-limiting embodiments or examples, where locomotive controller 72 determines that RF transceiver 36 of only a single wireless device 26 is transmitting data that railroad crossing 12 is clear for the passage of locomotive 4 therethrough, locomotive controller 72 can be programmed or configured to allow or cause locomotive 4 to travel through railroad crossing 12 at less than rated track speed, e.g., less than one-half of rated track speed, or less than or equal to about 15 miles per hour, or less than or equal to about 25 kilometers per hour. In some non-limiting embodiments or examples, where locomotive controller 72 receives data from RF transceivers 36 of two or more wireless devices 26 that railroad crossing 12 is clear for the passage of locomotive 4 therethrough, locomotive controller 72 can be programmed or configured to allow or cause locomotive 4 to travel through railroad crossing 12 at about rated track speed, e.g., greater than or equal to 80% of rated track speed.

In some non-limiting embodiments or examples, an advantage of having locomotive 4 travel through railroad crossing at less than rated track speed when locomotive controller 72 receives data from only a single wireless device 26 being controlled by a single flagger 24 is that the reduced track speed better enables locomotive 4 to travel through railroad crossing 12 when only a single flagger 24 may be present, for safety reasons. On the other hand, when locomotive controller 72 receives data from two or more wireless devices 26, controlled by two or more flaggers 24, locomotive controller 72 can be programmed or configured to allow or cause locomotive 4 to travel through railroad crossing 12 at about track speed under the assumption that the two or more flaggers are better able to determine that railroad crossing 12 is clear for the passage of locomotive 4 therethrough.

In some non-limiting embodiments or examples, and as discussed above, each wireless device 26 can include a user interface 48 including a user present contact 50 and a railroad crossing clear contact 54. In some non-limiting embodiments or examples, a flagger 24 can indicate to locomotive controller 72 his presence proximate railroad crossing 12 by activating the user present contact 50 of wireless device 26. Moreover, in an example, when the flagger 24 determines, e.g., via visual observation, that railroad crossing 12 is clear for the passage of locomotive 4 therethrough, said flagger 24 can actuate the railroad crossing clear contact 54 of his wireless device 26. The activation of user present contact 50 and/or railroad crossing clear contact 54 of each wireless device 26 can be communicated from the wireless device 26, via wireless communication channel 30 and/or wireless communication channel 32, to locomotive controller 72 via wireless locomotive receiver or transceiver 28.

In an example, upon receiving data that the user present contact 50 and the railroad crossing clear contact 54 of only a single wireless device 26 present proximate railroad crossing 12 are both activated, locomotive controller 72 can be programmed or configured to allow or cause locomotive 4 to travel through railroad crossing 12 at less than rated track speed, as discussed above. In some non-limiting embodiments or examples, where two or more wireless devices 26 controlled by two or more flaggers 24 are present proximate railroad crossing 12, each flagger 24 can activate the user present contact 50 of his corresponding wireless device 26 to indicate to locomotive controller 72 that the two or more flaggers 24 are present proximate railroad crossing 12. If the two or more flaggers 24 also activate the railroad crossing clear contact 54 of their respective wireless device 26, locomotive controller 72 can be programmed or configured to respond by allowing or causing locomotive 4 to travel through railroad crossing 12 at about rated track speed, as discussed above.

In some non-limiting embodiments or examples, if locomotive controller 72 determines that only a single railroad crossing clear contact 54 of two or more wireless devices 26 present proximate railroad crossing 12 has been activated, locomotive controller 72 can be programmed or configured to cause locomotive 4 to not pass through railroad crossing 12 under the assumption that railroad crossing 12 is not clear for the passage of locomotive 4 therethrough. This latter scenario may occur when one of the two or more flaggers 24 deems railroad crossing 12 not clear for the passage of locomotive 4 therethrough and does not activate the railroad crossing clear contact 54 of his corresponding wireless device 26.

In this manner, one or more wireless devices 26 can be utilized by a corresponding number of flaggers 24 to facilitate the safe passage or travel of locomotive 4 through railroad crossing 12 when it is decided by said flagger(s) 24 that it is clear for said passage of travel, or to prevent the passage or travel of locomotive 4 through railroad crossing 12 when it is deemed, by at least one flagger 24, that it is not safe for said passage or travel of train 2 through railroad crossing 12.

In some non-limiting embodiments or examples, when first and second wireless devices 26-1 and 26-2 are positioned proximate railroad crossing 12, the portable transceivers 36 thereof can be programmed or configured to be in communication with each other directly or via wayside wireless transceiver 34. In an example, first and second wireless devices 26-1 and 26-2 can be programmed or configured whereupon, in response to a flagger 24 activating the notice contact 52 of one wireless device 26 (e.g., 26-1), the wireless transceiver 36 of said wireless device 26 can output a wireless notice or alert which is received by the portable transceiver 36 of the other wireless device 26 (e.g., 26-2) which, in response to receiving said notice, can cause its notification means 56 to generate a human detectable notification.

In some non-limiting embodiments or examples, notification means 56 can include one of the following: a light, a vibrator, or an audio transducer. In some non-limiting embodiments or examples, the human detectable notification can include at least one of the following: the light illuminating or flashing, the vibrator vibrating, and/or the audio transducer generating an audible sound. Use of the notification means 56 in this manner enables the user of one wireless device 26 (e.g., 26-1) actuating a notice contact 52 thereof to output a wireless notice which is received by a second wireless device 26 (e.g., 26-2), which, in response to receiving the notice, can cause its notification means 56 to generate the human detectible notification. In this manner, the user of one wireless device 26, e.g., 26-1, can alert the user of the other wireless device, e.g., 26-2, for example, that locomotive 4 is approaching railroad crossing 12.

In some non-limiting embodiments or examples, locomotive controller 72 and/or controller 80 of wireless wayside transceiver 34 can be programmed or configured to cause data to be wireless transmitted that a distance between locomotive 4 and railroad crossing 12 is within a predetermined distance. Each wireless device 26 can be programmed or configured to receive this data and cause the notification means 56 thereof to generate a human detectible notification based on the received data. This enables the flagger 24 of each wireless device 26 to be notified that locomotive 4 approaching railroad crossing 12 is within the predetermined distance of railroad crossing 12.

In some non-limiting embodiments or examples, the predetermined distance can be determined by locomotive controller 72 with reference to GPS data output by GPS receiver 70. By comparing the present location of locomotive 4 determined from GPS data output by GPS receiver 70 to a GPS position of railroad crossing 12, acquired, for example, from a track database accessible to locomotive controller 72, one or more wireless devices 26 can be notified by locomotive controller 72 that locomotive 4 approaching railroad crossing 12 is within the predetermined distance, which predetermined distance may be based upon, among other things, the speed of the train. The track database may include a map of track 8 that is used by locomotive controller 72 to track the movement of train 2 on track 8. The map of track 8 may include GPS coordinates of at least some objects on or proximate track 8, including for example, the GPS coordinates of railroad crossing 12. In some non-limiting embodiments or examples, the notice generated by locomotive controller 72 when locomotive 4 is within the predetermined distance of railroad crossing 12 can be transmitted directly to each wireless device 26 via communication channel 30 or can be transmitted to each wireless device 26 via communication channel 32.

In another example, wireless wayside transceiver 34 can be positioned proximate railroad crossing 12 and the distance between locomotive 4 and railroad crossing 12 can be based on GPS coordinates determined from GPS data output by GPS receiver 70 and the GPS coordinates of wayside transceiver 34. In an example, the GPS coordinates of wayside transceiver 34 can be programmed into controller 80 or can be included in the track database accessible to locomotive controller 72. In another example, the GPS coordinates of wayside transceiver 34 can be acquired by controller 80 from an optional GPS receiver 86 of wayside transceiver 34. The GPS coordinates of wayside transceiver 34 can be used as a proxy for the geographical coordinates of railroad crossing 12. In an example, the distance between locomotive 4 and railroad crossing 12 can be determined by locomotive controller 72 from the present GPS coordinates of locomotive 4 and the GPS coordinates of wayside transceiver 34.

Having thus generally described a locomotive control system in accordance with the principles of the present invention and some operational aspects thereof, methods of locomotive control utilizing said locomotive control system will now be described.

Figure 3:
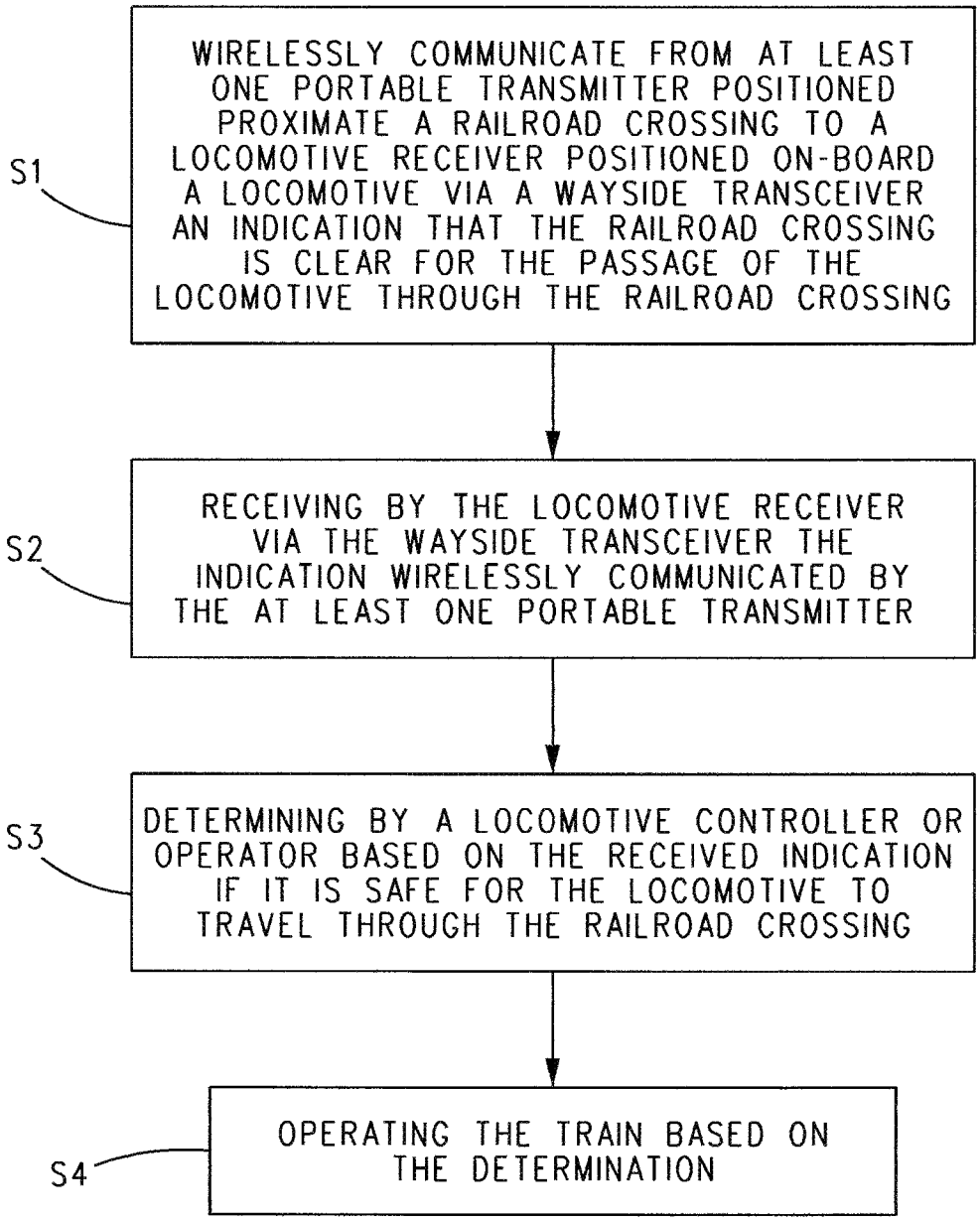
FIG. 3 is a flow diagram of an exemplary method in accordance with the principles of the present invention.

With reference to FIG. 3, a method of locomotive control in accordance with the principles of the present invention includes step S1, wherein an indication is wirelessly communicated from at least one portable (RF) transmitter 38 of a wireless device 26 positioned proximate railroad crossing 12 to an RF receiver 58 of locomotive 4 via wireless wayside transceiver 34 if railroad crossing 12 is clear for the passage of locomotive 4 through the railroad crossing 12. In step S2, RF receiver 58 receives the indication wirelessly communicated by the portable transmitter 38 via wayside transceiver 34.

In some non-limiting embodiments or examples, prior to step S1, the method can include receiving from an operator (e.g., a flagger) 24 of wireless device 26 an input related to the indication that the railroad crossing is clear for the passage for locomotive 4. This indication can be provided by the operator actuating a railroad crossing clear contact 54 of wireless device 26.

In some non-limiting embodiments or examples, the method can further include step S3 wherein locomotive controller 72 or an operator of locomotive 4 can determine based on the indication received by RF receiver 58 from at least one wireless device 26 if it is safe for locomotive 4 to travel through railroad crossing 12. In step S4, locomotive 4 can be operated based on the determination in step S3.

In some non-limiting embodiments or examples, when only a single wireless device 26 is provided, step S3 can include determining that the indication received by RF receiver 58 is wireless communicated by the single wireless device 26. Based on this determination, locomotive controller 72 can determine that it is safe for locomotive 4 to travel through railroad crossing 12. In some non-limiting embodiments or examples, because the notification is received only from a single wireless device 26, step S4 can include locomotive controller 72 causing locomotive 4 to travel through railroad crossing 12 at less than rated track speed, e.g., less than one-half of rated track speed.

In some non-limiting embodiments or examples, where a plurality of wireless devices 26 are provided, step S1 can include the plurality of wireless devices 26 wirelessly communicating a plurality of indications if railroad crossing 12 is clear for the passage of locomotive 4 through the railroad crossing 12. The indication wireless communicated by each wireless device 26 can be unique to the wireless device 26. In particular, each wireless device 26 can include a unique identifier that can be communicated as part of the indication wirelessly communicated by the wireless device 26. In an example, the unique identifier of each wireless device 26 may be a serial number or other such number or data that is unique to said wireless device 26. However, this is not to be construed in a limiting sense. The use of unique identifiers by wireless devices 26 enables locomotive controller 72 to distinguish which wireless device 26 is transmitting a particular indication that the railroad crossing is clear for the passage of locomotive 4 through said railroad crossing 12.

In some non-limiting embodiments or examples, step S2 can further include the locomotive RF receiver 58 receiving the plurality of indications from the plurality of wireless devices 26.

In some non-limiting embodiments or examples, step S3 can include locomotive controller 72 determining that the plurality of indications received by locomotive RF receiver 58 is wirelessly communicated by the plurality of RF transmitters 38 of the plurality of wireless devices 26. In an example, step S3 can further include locomotive controller 72 determining that it is safe for locomotive 4 to travel through railroad crossing 12 based on the plurality of indications received by RF receiver 58. In some non-limiting embodiments or examples, step S4 can include locomotive controller 72 operating locomotive 4 to travel through railroad crossing 12 at about rated track speed. In an example, "about rated track speed" can be greater than or equal to 80% of rated track speed. However, this is not to be construed in a limiting sense.

In some non-limiting embodiments or examples, RF transmitter 38 of at least one wireless device 26 can comprise an RF transceiver 36 of wireless device 26. The method can further include receiving by the RF transceiver 36 from the wireless wayside transceiver 34 a second indication that locomotive 4 has moved within a predetermined distance of the wireless wayside transceiver 34. This indication can be determined based on GPS coordinates of railroad crossing 12 or wireless wayside transceiver 34 and the present GPS coordinates of locomotive 4 determined from GPS data acquired by GPS receiver 70 of locomotive controller 72. In some non-limiting embodiments or examples, the predetermined distance can be stored at controller 80 of wireless wayside transceiver 34 or locomotive controller 72. The determination that locomotive 4 has moved within the predetermined distance of wireless wayside transceiver 34 can be performed by controller 80 or locomotive controller 72, which controller can also generate this indication. In some non-limiting embodiments or examples, in response to receiving this second notification, the notification means 56 of the wireless device 26 receiving the second indication can generate a human detectable notification.

In some non-limiting embodiments or examples, as discussed above, the second indication can be generated by locomotive controller 72 or controller 80 of wireless wayside transceiver 34 based on GPS coordinates of locomotive 4 and GPS coordinates of railroad crossing 12 or wireless wayside transceiver 34 accessible by locomotive controller 72 or controller 80 and used thereby to track movement of locomotive 4 toward railroad crossing 12 or wireless wayside transceiver 34.

In some non-limiting embodiments or examples, the indication in steps S1 and S2 can be based on a manual input to a contact (virtual or mechanical) of the at least one wireless device 26 that includes RF transmitter 38.

In some non-limiting embodiments or examples, step S4 can include the speed of the locomotive 4 being controlled through railroad crossing 12 based on GPS coordinates of locomotive 4 and wireless wayside transceiver 34 used to track movement of locomotive 4 toward wireless wayside transceiver 34.

Figure 4:
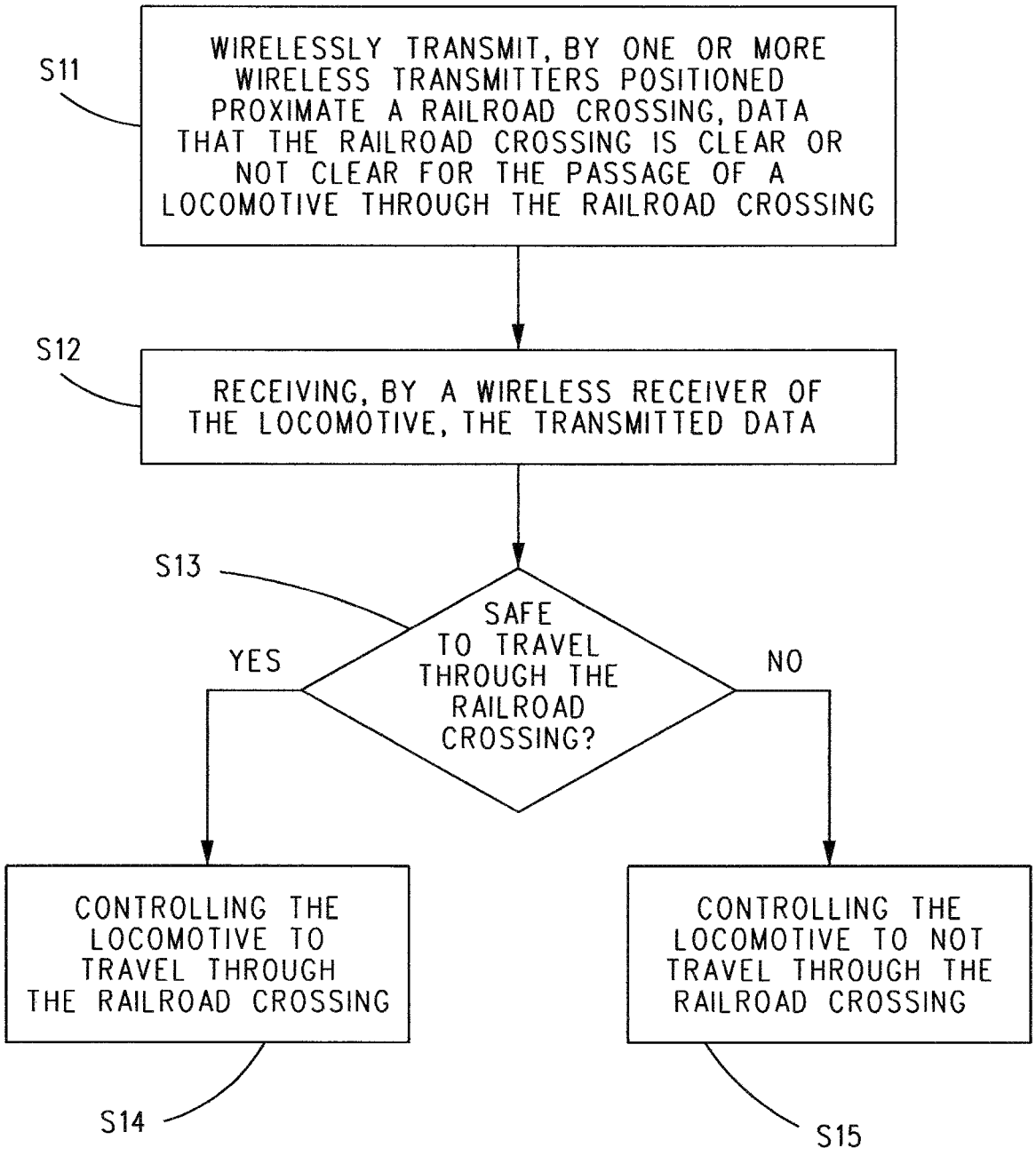
FIG. 4 is a flow diagram of an exemplary method in accordance with the principles of the present invention.

With reference to FIG. 4, in some non-limiting embodiments or examples, a locomotive control method in accordance with the principles of the present invention can include step S11, wherein data can be wirelessly transmitted, by one or more wireless (RF) transmitters 38 positioned proximate railroad crossing 12, that railroad crossing 12 is clear or not clear for passage of locomotive 4 through railroad crossing 12. In step S12, a wireless (RF) receiver 58 of locomotive 4 can receive the data wirelessly transmitted in step S11. In step S13, locomotive controller 72 or an operator of locomotive 4 can determine, based on the data received in step S12, if it is safe for locomotive 4 to travel through railroad crossing 12. If so, the method advances to step S14 wherein locomotive controller 72 or the operator of locomotive 4 can control locomotive 4 to travel through the railroad crossing 12. However, if, in step S13, it is determined that it is not safe for locomotive 4 to travel through railroad crossing 12, locomotive controller 72 or the operator of locomotive 4 can control the locomotive 4 to not travel through the railroad crossing 12.

Where locomotive controller 72 controls locomotive 4 to travel or not travel through railroad crossing 12, locomotive controller 72 can be programmed or configured to automatically respond to the data wirelessly transmitted in step S11 to control locomotive 4 to travel or not travel through railroad crossing 12. In an example, where only a single RF transmitter 38 (of a single wireless device 26) is positioned proximate railroad crossing 12 and a user (flagger) 24 thereof activates the user present contact 50 of said wireless device 26 indicating the user's presence at or proximate railroad crossing 12 and also activates the railroad crossing clear contact 54, indicating that railroad crossing 12 is clear for the passage of locomotive 4 therethrough, locomotive controller 72 can respond to the activation of contacts 50 and 54 by causing or allowing locomotive 4 to travel through railroad crossing 12, for example, at less than rated track speed. On the other hand, if the user of the single wireless device 26 activates the user present contact 50 but does not activate the railroad crossing clear contact 54, suggesting that it is not clear for locomotive 4 to travel through railroad crossing 12, locomotive controller 72 can respond by controlling one or more of the brakes 92 and/or throttle 94 of locomotive 4 such that locomotive 4 does not travel through railroad crossing 12.

In some non-limiting embodiments or examples, in another example where two or more wireless devices 26 controlled by two or more users (flaggers) 24 are positioned proximate railroad crossing 12, locomotive controller 72 will only permit locomotive 4 to travel through railroad crossing 12 when the user present contact 50 and the railroad crossing clear contact 54 of each wireless device 26 is activated. If the railroad crossing clear contact 54 of at least one wireless device 26 is not activated, locomotive controller 72 can respond by controlling locomotive 4 to not travel through railroad crossing 12.

In some non-limiting embodiments or examples, in step S14, locomotive 4 can be controlled to travel through railroad crossing 12 at about rated track speed when RF transceiver 62 receives data in step S12 from two or more wireless devices 26 positioned proximate railroad crossing 12. In some non-limiting embodiments or examples, to enable an operator of locomotive 4 or locomotive controller 72 to automatically determine that data is received from two or more wireless devices 26, each wireless device 26 can include an identifier that is unique to said wireless device 26 and which is different from an identifier of each other wireless device 26. The data transmitted by each wireless device 26 can then include the unique identifier associated with the wireless device 26.

In some non-limiting embodiments or examples, step S14 can include locomotive 4 traveling through railroad crossing 12 at less than rated track speed, e.g., less than one-half of rated track speed, when the RF receiver 58 receives data in step S12 from only a single wireless device 26 positioned proximate railroad crossing 12.

In some non-limiting embodiments or examples, the data can be wirelessly transmitted from RF transmitter 38 of a wireless device 26 to the RF receiver 58 of wireless locomotive receiver or transceiver 28 either directly (via wireless communication channel 30) or indirectly via wireless wayside transceiver 34 (wireless communication channel 32). In an example, wireless wayside transceiver 34 can be positioned proximate railroad crossing 12. In this example, at least one of wireless RF receiver 58 and RF transmitter 38 can comprise a wireless transceiver.

The method can further include each wireless device 26 receiving second wirelessly transmitted data that locomotive 4 has moved within a predetermined distance of railroad crossing 12. In response to receiving this second data, each wireless device 26 can cause the notification means 56 thereof to generate a human detectible notification. In an example, the generation of the second data can be based on a distance between locomotive 4 and railroad crossing 12 or, if provided, wireless wayside transceiver 34. In an example, this distance can be determined from the present GPS coordinates of locomotive 4 and the GPS coordinates of railroad crossing 12 and/or wireless wayside transceiver 34.

Figure 5:
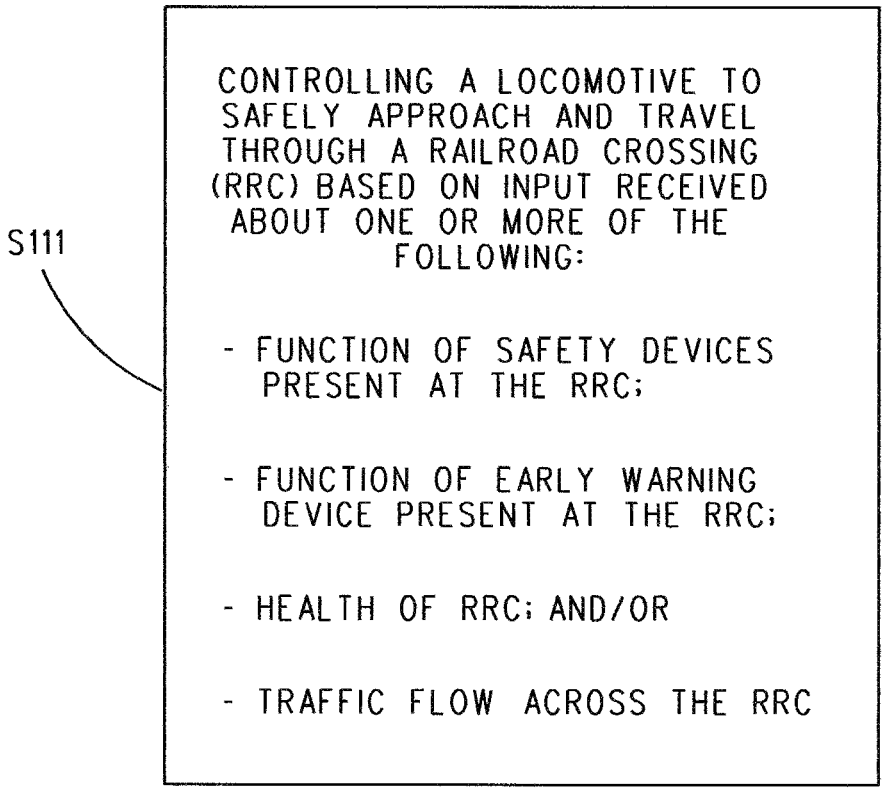
FIG. 5 is a flow diagram of an exemplary method in accordance with the principles of the present invention.

With reference to FIG. 5, in some non-limiting embodiments or examples, a locomotive control method in accordance with the principles of the present invention can include step S111 comprising controlling locomotive 4 to safely approach and travel through railroad crossing 12 based on input received (e.g., received input) about one or more of the following: a state of functioning of one or more safety devices present at the railroad crossing; a state of functioning of one or more warning devices present at the railroad crossing; a state of health of the railroad crossing itself; and/or a state of traffic flow across the railroad crossing. In an example, the one or more safety devices may include a gate that, in normal operation, can be lowered to warn vehicular traffic that a train is approaching. The one or more warning devices may include one or more flashing lights and/or a bell that can be controlled to ring. The state of health of the railroad crossing itself may include whether or not the track, the roadway, or both is/are in a state that renders dangerous the passage of locomotive 4 and/or vehicle(s) 16 through railroad crossing 12. The state of traffic flow across railroad crossing 12 can include whether or not any vehicle is positioned on or near the portion of track 8 in railroad crossing 12.

In some non-limiting embodiments or examples, the received input can be provided directly to the locomotive via one or more remote devices, for example, one or more wireless devices 26, triggered by human input via communication link of wireless communication channel 30. In another example, the received input can be provided indirectly to locomotive 4 via wireless communication link or channel 32 and wireless wayside transceiver 34 positioned proximate railroad crossing 12.

In some non-limiting embodiments or examples, the method can further include determining an allowed speed for locomotive 4 to travel through the railroad crossing 12 based on the received input. In an example, the speed of locomotive 4 can be adjusted from a current speed to an allowed speed. For example, this speed adjustment can occur in response to the received input being received from a single wireless device 26.

Where two or more wireless devices 26 are provided, the second wireless device 26-2 can be interrogated by the first wireless device 26-1 to provide the input that is received by locomotive 4. In an example, delivery of the input from the first wireless device 26-1 can be directly to the locomotive or indirectly to the locomotive via the second wireless device 26-2. In other words, instead of the first and second wireless devices 26-1 and 26-2 separately providing the input directly or indirectly to locomotive 4, the first wireless device 26-1 can provide its input to the second wireless device 26-2 which can, in-turn, provide its input and the input from the first wireless device 26-1 to locomotive 4.

In some non-limiting embodiments or examples, the method can include adjusting the speed of locomotive 4 such that locomotive 4 does not travel through the railroad crossing 12. This may occur when the state of health of the railroad crossing will not permit the passage of vehicular traffic or locomotive 4 through the railroad crossing 12 or a vehicle is positioned in the portion of track 8 comprising railroad crossing 12.

As can be seen, disclosed herein is a locomotive control method comprising: (a) wirelessly communicating from at least one wireless portable transmitter 26 positioned proximate a railroad crossing 12 to a wireless locomotive RF receiver 58 of a locomotive 4 via a wireless wayside transceiver 34 an indication if the railroad crossing 12 is clear for passage of the locomotive 4 through the railroad crossing 12; and (b) receiving by the locomotive RF receiver 58 via the wayside transceiver 34 the indication wirelessly communicated by the at least one portable transmitter 26.

Prior to step (a) the method can include the step of: receiving from an operator 24 of the at least one portable transmitter 26 an input (50, 54 or both) related to the indication.

The method can further include: (c) determining, by a locomotive controller 72 or an operator of the locomotive 4 based on the indication received by the locomotive RF receiver 58 from the at least one portable transmitter 26, if it is safe for the locomotive 4 to travel through the railroad crossing 12.

The method can further include: (d) operating the locomotive 4 based on the determination in step (c).

The at least one portable transmitter 26 can consists of a single portable transmitter 26-1. Step (c) can include: (c)(1) determining that the indication received by the locomotive RF receiver 58 is wirelessly communicated by the single portable transmitter 26-1; and (c)(2) determining that it is safe for the locomotive 4 to travel through the railroad crossing 12 based on the indication received by the locomotive RF receiver 58 wirelessly communicated by the single portable transmitter 26-1. Step (d) can include operating the locomotive 4 to travel through the railroad crossing 12 at less than a rated track speed.

The at least one portable transmitter 26 can include a plurality of portable transmitters 26-1 and 26-2. Step (a) can include the plurality of portable transmitters 26-1 and 26-2 wirelessly communicating a plurality of indications if the railroad crossing 12 is clear for passage of the locomotive 12 through the railroad crossing 12, wherein the indication wirelessly communicated by each portable transmitter 26 is unique to said portable transmitter 26. Step (b) can include the locomotive RF receiver 58 receiving the plurality of indications. Step (c) can include: (c)(1) determining that the plurality of indications received by the locomotive RF receiver 58 is wirelessly communicated by the plurality of portable transmitters 26-1 and 26-2; and (c)(2) determining that it is safe to for the locomotive 4 to travel through the railroad crossing 12 based on the plurality of indications received by locomotive RF receiver 58 wirelessly communicated by the plurality of portable transmitters 26-1 and 26-2. Step (d) can include operating the locomotive 4 to travel through the railroad crossing 12 at about rated track speed.

The at least one portable transmitter 26 can comprise a wireless portable transceiver 36. The method can further comprise receiving by the portable transceiver 36 from the wayside transceiver 34 a second indication that the locomotive 4 has moved within a predetermined distance of the wayside transceiver 34. In response to receiving the second indication, the portable transceiver 36 generating, by a notification means 56 associated therewith, a human detectable notification. The notification means can include at least one of the following: a light, a vibrator, or an audio transducer. The human detectable notification can includes at least one of the following: the light illuminating, the vibrator vibrating, or the audio transducer generating an audible sound.

The second indication can generated by the locomotive controller 72 or a wayside controller 80 coupled to the wayside transceiver 74 based on GPS coordinates of the locomotive 4 and the wayside transceiver 74 accessible by the locomotive controller 72 or the wayside controller 80 and used by the locomotive controller 72 or the wayside controller 80 to track movement of the locomotive 4 toward the wayside transceiver 74.

The indication can based on a manual input to a contact (virtual or mechanical) of the portable transmitter 26.

Step (d) can include controlling a speed of the locomotive 4 through the railroad crossing 12 based on GPS coordinates of the locomotive 4 and the wayside transceiver 74 used to track movement of the locomotive toward the wayside transceiver.

Also disclosed is a locomotive control method comprising: (a) wirelessly transmitting, by each of one or more wireless transmitters 26/38 positioned proximate a railroad crossing 12, data that the railroad crossing 12 is clear or not clear for passage of a locomotive 4 through the railroad crossing 12; (b) receiving, by a wireless RF receiver 58 of the locomotive 4, the data transmitted in step (a); (c) determining, by a controller 72 or an operator of the locomotive 4 based on the data received in step (b), if it is safe for the locomotive 4 to travel through the railroad crossing 12; and (d) controlling, by the controller 72 or the operator, the locomotive 4 to: (1) travel through the railroad crossing 12 if it is determined in step (c) that it is safe for the locomotive 4 to travel through the railroad crossing 12; or (2) not travel through the railroad crossing 12 if it is determined in step (c) that it is not safe for the locomotive 4 to travel through the railroad crossing 12.

The data can include an indication of the presence of an operator 24 of the wireless transmitter 26/38.

Step (d)(1) can include the locomotive 4 traveling through the railroad crossing at about rated track speed when the wireless receiver 26/38 of the locomotive 4 receives the data in step (b) from two wireless transmitters 26/38 positioned proximate the railroad crossing 12.

Each wireless transmitter 26/38 can include a identifier that is unique to said wireless transmitter and which is different from an identifier of each other wireless transmitter. The data transmitted by each wireless transmitter 26/38 includes said unique identifier.

Step (d)(1) can include the locomotive 4 traveling through the railroad crossing 12 at less than rated track speed when the wireless RF receiver 58 of the locomotive 12 receives the data in step (b) from only a single wireless transmitter 26/38 positioned proximate the railroad crossing 12.

The locomotive 4 traveling through the railroad crossing 12 at less than rated track speed can include the locomotive 4 traveling through the railroad crossing 12 at ≤about 15 miles/hour or ≤about 25 kilometers/hour.

The wireless transmitter 26/38 can include one or more contacts 50, 52, 54 (virtual or mechanical) for receiving input related to the data.

The data can be wirelessly transmitted from the wireless transmitter 26/38 to the wireless RF receiver 58 via a wireless wayside transceiver 34. The wayside transceiver 34 can be positioned proximate the railroad crossing 12. At least one of the wireless RF receiver 58 and the wireless transmitter 26/38 can comprise a wireless transceiver 36, 62.

Each wireless transmitter 26/38 can comprises a wireless transceiver 36. The method can further comprise: receiving by each wireless transceiver 36 second wirelessly transmitted data that the locomotive 4 has moved within a predetermined distance of the railroad crossing 12; and in response to each wireless transceiver 36 receiving the second data, a notification means 56 of the wireless transmitter 26/38 including the wireless transceiver 36 generating a human detectable notification.

The notification means can include at least one of the following: a light, a vibrator, or an audio transducer. The human detectable notification can include at least one of the following: the light illuminating, the vibrator vibrating, or the audio transducer generating an audible sound.

The second data can be based on a distance between the locomotive 4 and the railroad crossing 12.

Also disclosed is a locomotive control system comprising: at least one wireless portable transceiver 26/36 positioned proximate a railroad crossing; 12 and a locomotive 4 including an on-board wireless locomotive RF transceiver 62 and a locomotive controller 72, wherein: each portable transceiver 26/36 is programmed or configured to wirelessly transmit data that the railroad crossing 12 is clear or not clear for passage of the locomotive 4 through the railroad crossing 12; and the locomotive transceiver 62 is programmed or configured to receive the data transmitted by each portable transceiver 26/36 and to provide the received data to the locomotive controller 72 which is programmed or configured to control the locomotive 4 to travel or not travel through the railroad crossing 12 based on the provided data.

The at least one portable transceiver 26/36 includes first and second portable transceivers 26-1/36 and 26-2/36 in communication with each other directly or via a wireless wayside transceiver 34, wherein the first and second portable transceivers 26-1/36 and 26-2/36 are programmed or configured whereupon, in response to user input thereon, the first portable 26-1/36 transceiver outputs a wireless notice which is received by the second portable transceiver 26-2/36 which, in response to receiving the notice, causes a notification means 56 of the second portable transceiver 26-2/36 to generate a human detectable notification.

The locomotive RF transceiver 62 can be further programmed or configured to wirelessly transmit second data generated by the locomotive controller 72 that a distance between the locomotive 4 and the railroad crossing 12 is within a predetermined distance. Each portable transceiver 26/36 can be further programmed or configured receive the second data and to cause a notification means 56 of the portable transceiver 26/36 to generate a human detectable notification based on the received second data.

The system can further include a wireless wayside transceiver 34 programmed or configured to receive the data transmitted by each portable transceiver 26/36 and to retransmit the received data to the locomotive transceiver 62 and/or for receiving the second data transmitted the locomotive transceiver 62 and to retransmit the received second data to each portable transceiver 26/36.

The wayside transceiver 34 can be positioned proximate the railroad crossing 12. The distance between the locomotive 4 and the railroad crossing 12 can be based on GPS coordinates of the locomotive 4 and the wayside transceiver 34.

Also disclosed is a locomotive control method, comprising controlling a locomotive 4 to safely approach and travel through a railroad crossing 12 based on input received about one or more of the following: state of functioning of safety devices 20, 22 present at the railroad crossing; state of functioning of early warning devices (e.g., a gate) present at the railroad crossing 12; state of health of the railroad crossing 125; and/or state of traffic 16 flow across the railroad crossing 12.

The method can further comprise providing the input directly to the locomotive 4 via one or more remote devices 26 triggered by human input.

The method can further comprise providing the input indirectly to the locomotive 4 via a communication link 34 disposed proximate the railroad crossing 12.

The method can further comprise determining an allowed speed for the locomotive 4 based on the received input. The method can further comprise adjusting a speed of the locomotive 4 from a current speed to the allowed speed.

The method can further comprise interrogating a second remote device 26-2 from a first remote device 26-1 to provide the input.

The method can further comprise delivering the input from the first remote device 26-1 directly to the locomotive 4 or indirectly to the locomotive 4 via the second remote device 26-2.

The method can further comprise adjusting the speed of the locomotive 4 such that the locomotive does not travel across the railroad crossing 12.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method comprising:

wirelessly receiving indications of whether a route crossing is clear for passage of a vehicle through the route crossing, the indications communicated from wireless portable transmitters carried by human flaggers positioned proximate the route crossing to a wireless wayside transceiver and then communicated to a wireless vehicle receiver of the vehicle via the wireless wayside transceiver;

determining whether the indications were received from one or more of a first wireless portable transmitter or a second wireless portable transmitter; and operating the vehicle according to first operating settings responsive to determining that the indications were received from the first wireless portable transmitter but not the second wireless portable transmitter, or operating the vehicle according to second operating settings responsive to determining that the indications were received from the first wireless portable transmitter and the second wireless portable transmitter.

2. The method of claim 1, further comprising:

determining whether the vehicle can safely travel through the route crossing using a vehicle controller based on the indications received by the wireless vehicle receiver from the wireless portable transmitters.

3. The method of claim 2, further comprising:

operating the vehicle based on determining whether the vehicle can safely travel through the route crossing.

4. The method of claim 3, further comprising:

determining whether the indications received by the wireless vehicle receiver are wirelessly received from (a) both the first wireless portable transmitter of the two or more wireless portable transmitters and the second wireless portable transmitter of the plural wireless portable transmitters via the wireless wayside transceiver or (b) the first wireless portable transmitter but not the second wireless portable transmitter via the wireless wayside transceiver;

operating the vehicle to travel through the route crossing at a rated speed responsive to determining that the indications are wirelessly received from (a) both the first wireless portable transmitter and the second wireless portable transmitter via the wireless wayside transceiver; and operating the vehicle to travel through the route crossing slower than a rated speed responsive to determining that the indication indications are wirelessly received from (b) the first wireless portable transmitter but not the second wireless portable transmitter via the wireless wayside transceiver.

5. The method of claim 3, further comprising:

controlling a speed of the vehicle through the route crossing based on coordinates of the vehicle and the wireless wayside transceiver used to track movement of the vehicle toward the wireless wayside transceiver.

6. The method of claim 1, wherein the indications are based on a manual input to a contact of the at least one wireless portable transmitter.

7. A method comprising:

receiving, by a wireless receiver of a vehicle via a wireless wayside transceiver located at a route crossing, data that is wirelessly transmitted from one or more wireless portable transmitters carried by one or more human flaggers disposed at the route crossing to the wireless wayside transceiver, the data indicating that the route crossing is clear for passage of the vehicle through the route crossing;

determining, by a controller of the vehicle, if a number of the wireless portable transmitters that wirelessly transmitted data is the same as a number of the human flaggers disposed at the route crossing; and controlling the vehicle to travel through the route crossing according to first operating settings or second operating settings, wherein the vehicle is configured to be controlled according to the first operating settings responsive to determining that the number of the wireless portable transmitters that wirelessly transmitted data is the same as the number of human flaggers, wherein the vehicle is configured to be controlled according to the second operating settings responsive to determining that the number of the wireless portable transmitters that wirelessly transmitted data is not the same as the number of human flaggers.

8. The method of claim 7, wherein the data includes an indication of a presence of the one or more human flaggers of the one or more wireless portable transmitters.

9. The method of claim 7, wherein the first operating settings includes controlling the vehicle to travel through the route crossing at a rated speed.

10. The method of claim 9, wherein the data transmitted by the at least two of the one or more wireless portable transmitters includes one or more unique identifiers of each of the at least two wireless portable transmitters.

11. The method of claim 7, wherein the second operating settings includes controlling the vehicle is controlled to travel through the route crossing at slower than a rated speed.

12. The method of claim 11, wherein the vehicle traveling through the route crossing at the slower than the rated speed includes the vehicle traveling through the route crossing at no faster than twenty-five kilometers per hour.

13. A method comprising:

receiving an indication at a receiver disposed onboard a vehicle moving toward an intersection, the indication received by the receiver from a first portable transmitter carried by a first operator at the intersection via a wayside transceiver disposed at the intersection;

determining whether the indication is also received at the receiver onboard the vehicle from a second portable transmitter carried by a second operator at the intersection via the wayside transceiver;

controlling the vehicle to move through the intersection up to a first threshold speed responsive to determining that the indication is received from both the first portable transmitter and the second portable transmitter via the wayside transceiver; and controlling the vehicle to move through the intersection up to a second threshold speed that is slower than the first threshold speed responsive to determining that the indication is received from the first portable transmitter but is not received from the second portable transmitter via the wayside transceiver.

14. The method of claim 13, wherein the indication includes a unique identifier of the first portable transmitter.

15. The method of claim 13, further comprising:

determining that the vehicle is within a threshold distance of the intersection; and communicating a notification to the first portable transmitter and the second portable transmitter responsive to determining that the vehicle is within the threshold distance of the intersection.

* * * * *